US005304082A

United States Patent [19]

Wolfe

[11] Patent Number: 5,304,082

[45] Date of Patent: Apr. 19, 1994

[54] RECREATIONAL FLOATATION DEVICE

[75] Inventor: Henry Wolfe, Palmetto, Fla.

[73] Assignee: Aqua-Leisure Industries, Inc., Avon, Mass.

[21] Appl. No.: 89,728

[22] Filed: Jul. 9, 1993

[51] Int. Cl.[5] ..... B63B 7/08

[52] U.S. Cl. ..... 441/129; 441/131; 114/345

[58] Field of Search ..... 114/345; 441/40, 129, 441/130, 131

[56] References Cited

U.S. PATENT DOCUMENTS

| | | | |
|---|---|---|---|
| 1,960,474 | 5/1934 | Browne | 441/129 |
| 2,013,410 | 9/1935 | Howland | 441/130 |
| 2,253,936 | 8/1941 | Karst | 441/131 |
| 2,803,839 | 8/1957 | Mosley | 9/11 |
| 2,980,927 | 4/1961 | Waters | 9/347 |
| 4,932,912 | 6/1990 | Combs | 441/129 |
| 5,122,086 | 6/1992 | Remy | 441/129 |
| 5,167,551 | 12/1992 | Davis | 441/57 |
| 5,167,554 | 12/1992 | Tager | 441/131 |
| 5,171,178 | 12/1992 | Creek | 441/132 |

FOREIGN PATENT DOCUMENTS

| | | | |
|---|---|---|---|
| 2217683 | 1/1989 | United Kingdom | 441/129 |

*Primary Examiner*—David M. Mitchell
*Assistant Examiner*—Stephen P. Avila
*Attorney, Agent, or Firm*—Wolf, Greenfield & Sacks

[57] ABSTRACT

A recreational floatation device. The floatation device includes an inflatable main body having an elongated horizontal axis and a flattened configuration. When inflated, the device has a buoyancy in water sufficient to support a plurality of users. The main body preferably has at least two openings positioned along the elongated horizontal axis. A main body valve is secured on the main body. The device also preferably includes at least two inflatable bladders, which are encompassed by the main body, positioned along the elongated horizontal axis and adjacent to the main body openings. Each of the bladders has a bladder valve which is secured on the main body. The main body and bladders are inflatable through the main body and bladder valves, respectively.

14 Claims, 2 Drawing Sheets

RECREATIONAL FLOATATION DEVICE

BACKGROUND OF THE INVENTION

1. Field of the Invention

The present invention relates to a recreational floatation device and, more particularly, to a recreational floatation device for use in a body of water by a plurality of users.

2. Description of the Prior Art

Conventional flotation devices having buoyancy for recreational use in a body of water, such as a swimming pool, include a wide variety of structures, such as chairs, rafts, and ring tubes. Typically, these toys are made of a vinyl plastic material, and are sized and shaped to accommodate one person, typically a child, while floating in a body of water.

For example, a prior art floatation device is disclosed by Waters, in U.S. Pat. No. 2,980,927, and includes a chair-like, U shaped structure in which a bather may recline or paddle about in the water. Similarly, a buoyant chair is disclosed by Mosley in U.S. Pat. No. 2,803,839. Rigid, buoyant devices for recreational use are disclosed by Davis in U.S. Pat. No. 5,167,551 and Combs in U.S. Pat. No. 4,932,912 which assist users in body surfing and swimming. An inflatable personal floatation device for use by fishermen is disclosed by Creek in U.S. Pat. No. 5,171,178; and an inflatable device for use by a single user in a body of water, including a liquid squirter, is disclosed by Tager in U.S. Pat. No. 5,167,554.

Although providing a wide variety of floatation devices for many different applications, none of the foregoing, or similar devices, provide a comfortable, durable and aesthetically pleasing, recreational floatation device for a plurality of users.

It is therefore an object of this invention to provide an improved recreational floatation device, which can safely accommodate a plurality of users while providing a more comfortable and aesthetically pleasing effect.

A further object of this invention is to provide a floatation device that is aesthetically pleasing and comfortable to use.

SUMMARY OF THE INVENTION

Accordingly, the present invention provides a recreational floatation device. The floatation device includes an inflatable main body having an elongated horizontal axis and a flattened configuration. When inflated, the device has a buoyancy in water sufficient to support a plurality of users. The main body has at least two openings, each sized to receive a user, which are positioned along the horizontal axis. A main body valve is secured on the main body for inflating the floatation device.

The floatation device preferably also includes at least two inflatable bladders, which are encompassed by the main body, positioned along the elongated horizontal axis and adjacent to the main body openings. Each of the bladders has a bladder valve which is secured on the main body. The main body and bladders are inflatable through the first and second valves, respectively.

In and alternative embodiment, a recreational floatation device includes an inflatable main body for inflation. The main body is defined by a plastic wall. A stretchable fabric material overlaying the plastic wall is also provided to give the device a comfortable and aesthetically pleasing effect to a user.

The floatation device of the present invention can be shaped and designed in a wide variety of aesthetically pleasing figures, such as a fish, or an animal. Furthermore, in an alternative embodiment of the present invention, the main body of the floatation device is covered by a stretchable fabric material. In the latter case, the floatation device can be designed in a variety of configurations, covered by fabric which is aesthetically pleasing and comfortable to touch.

BRIEF DESCRIPTION OF THE DRAWINGS

The foregoing and other objects and advantages of the invention will be appreciated more fully from the following drawings in which.

DETAILED DESCRIPTION OF THE INVENTION

The present invention is directed to a recreational floatation device including an inflatable main body having an elongated axis and a flattened configuration, and at least two openings positioned along the horizontal axis. The floatation device also preferably includes at least two inflatable bladders, which are encompassed by the main body and positioned along the horizontal axis, adjacent to the openings. The main body and the bladders of the floatation device are inflatable through the main body and bladder valves, respectively. The bladders aid in providing additional buoyancy to the main body, should it lose filling gas.

Figure 1:
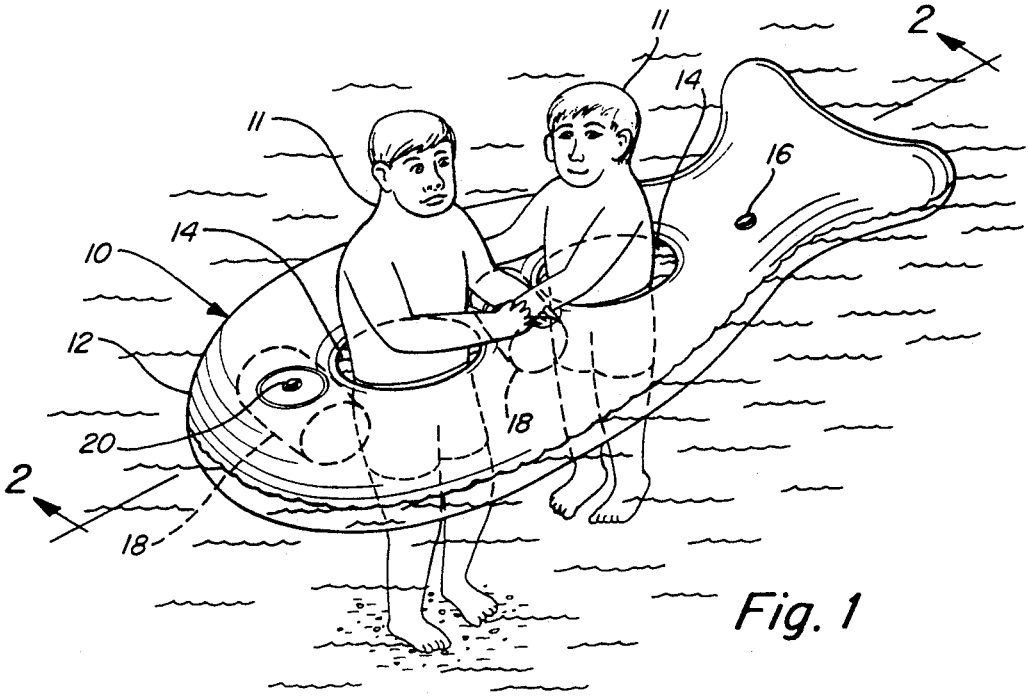
FIG. 1 is a perspective view of the recreational floatation device of the present invention.
Figure 2:
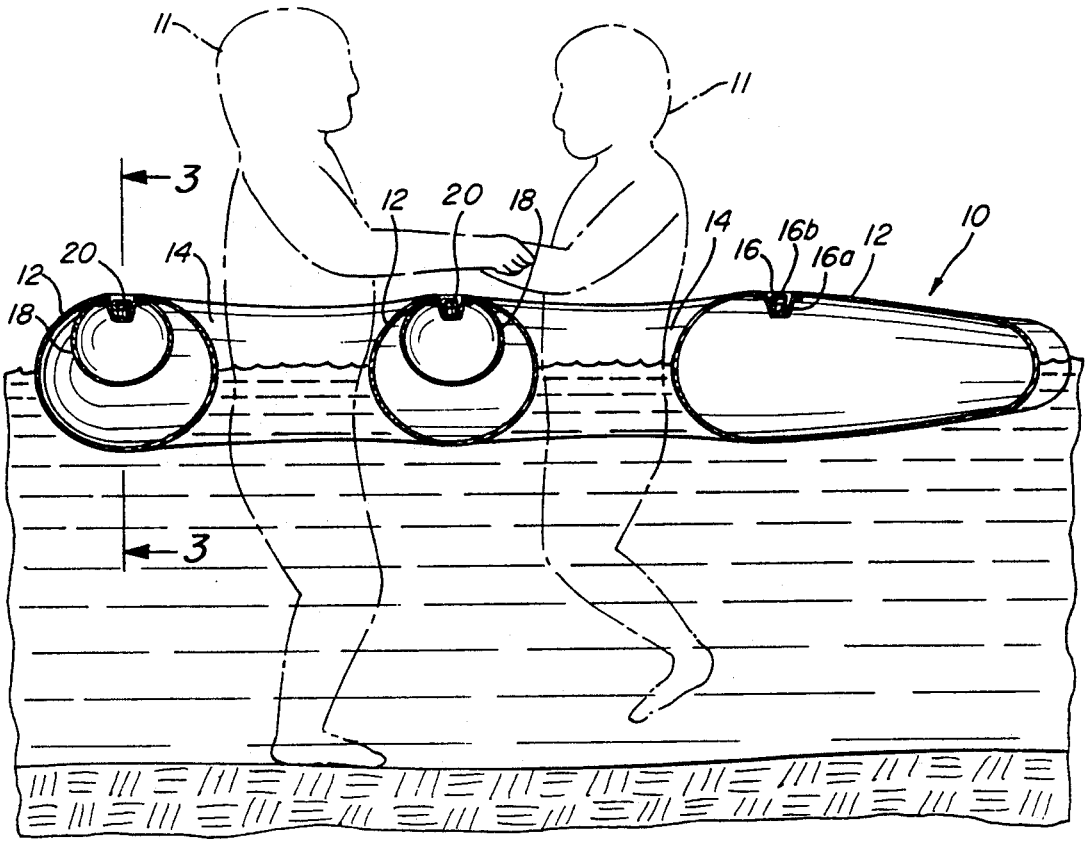
FIG. 2 is a cross sectional side view taken along line 2—2 of FIG. 1.
Figure 3:
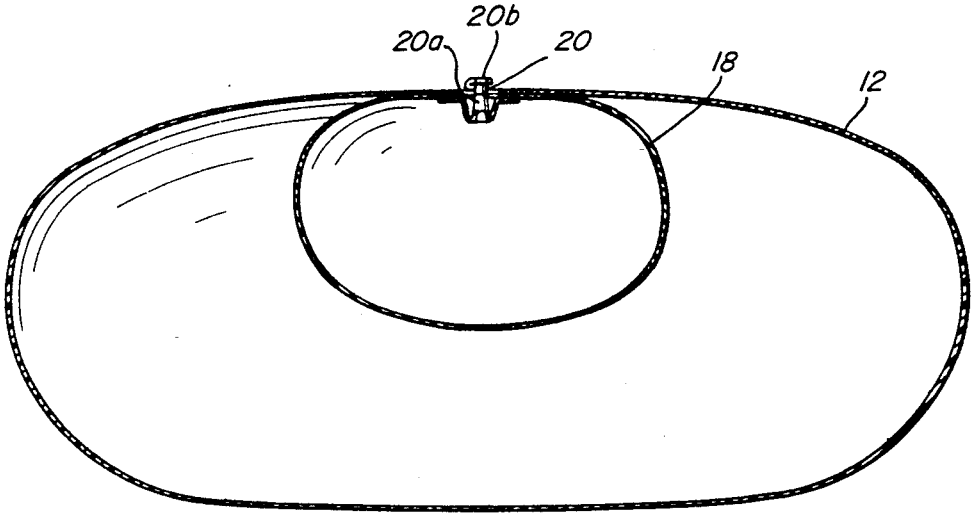
FIG. 3 is a cross sectional side view taken along line 3—3 of FIG. 2.

Turning now to the figures, wherein like reference numerals indicate like elements, FIGS. 1, 2 and 3 represent one embodiment of a recreational floatation device 10 of the present invention.

FIG. 1 shows a perspective view of device 10 floating in a body of water with a plurality of users 11 Device 10 includes an inflatable main body 12 which has an elongated horizontal axis and a flattened configuration. Main body 12 has at least two openings 14 which are positioned along the horizontal axis. The openings 14 are preferably spaced apart, however they are near enough to enable users 11 to be within arms reach of each other. A main body valve 16 is secured on main body 12. Device 10 also includes at least two inflatable bladders 18, which are encompassed by main body 12, and are positioned along the elongated horizontal axis and adjacent to main body openings 14. Both bladders 18 include a bladder valve 20 (see also FIG. 2) which is also secured on main body 12. Main body 12 and bladders 18 are inflatable through main body and bladder valves 16, 20, respectively. As noted above, and as shown, when main body 12 is inflated it has a buoyancy in water sufficient to support the plurality of users 11.

Main body 12 is typically constructed of a soft, flexible, resilient material. In addition, main body 12 should be made of a material that is relatively inexpensive while providing satisfactory weathering and sunlight resistance, as well as good sealing and mechanical properties. The material should be chemically resistant to swimming pool chemicals, such as chlorine, as well as resistant to the deleterious effects of salt water. Typically, main body 12 is constructed of a vinyl plastic material, which addresses the above preferred characteristics. Preferably, inflatable main body 12 is constructed of polyvinyl chloride, due to its relative inexpensive cost and availability, as well as its advantageous physical characteristics. It is noted, however, that other materials known to those of skill in the art, could be used to form main body 12. For example, polyethylene, polypropylene, nylon, latex, neoprene rubber, or a chlorosulfonated polyethylene, such as HYPALON TM synthetic rubber material (trademark of E. I. DuPont de Nemours Co., Wilmington, Del.), could be processed to provide the above-noted preferred characteristics of main body 12. Typically, plastics or rubber additives, such as stabilizers, anti oxidants, and plasticizers, are added to the main component material (preferably, polyvinyl chloride) to maintain or enhance softness and pliability, as well as to provide resistances to weathering, chemicals, and/or mildew. Furthermore, other additives are added to provide additional strength and/or color to the main component. These additives are all well known to those skilled in the art; plasticizers, for example, include polyols such as ethylene glycol and its derivatives. After the desired additives are mixed into the main component material, main body 12 is formed by processes known to those skilled in the art, such as calendaring, casting, extruding, or molding. Main body 12 may be formed, for example, by heat sealing an upper and lower portion, which are similarly shaped, around the outer and inner peripheries. Typically, the material of construction of the inflatable main body 12 has a thickness of between about 5 and about 25 gauge, and preferably between about 5 and about 15 gauge. It has been found that thicknesses within this range provide adequate strength while allowing the main body 12 to be easily inflated. Most preferably, the main body material has a thickness of at least about 10 gauge.

Main body 12 includes at least two openings 14 which are positioned along the horizontal axis. Openings 14 can be any shape and size to receive the torso of a user 11. Typically, openings 14 are shaped in size to receive the torso of a child; therefore, openings 14 are preferably circular or oval in shape and have a diameter of less than 12 inches. As noted above, openings 14 are positioned along the horizontal axis of device 10. This positioning allows the arms of users 11 to engage a body of water for maneuvering the device from one location to another in the body of water. It is noted that the positioning of openings 14 also allow a plurality of users to engage each other.

A main body valve 16 is secured on main body 12. Valve 16 can be any standard inflation valve, commercially available and known to those of skill in the art. Preferably, the valve 16 is a self-sealing, or one way valve commonly known as a safety valve, which allows air flow into main body 12. A forceful stream of air, from a foot pump, hand pump, compressed air container, or the like, can be introduced into main body 12 through valve 16. When the main body is inflated by mouth however, valve cylinder **16*a* is first pinched as air pressure from the lungs is usually insufficient to force open the check flap portion of a typical safety valve. Air will not flow into or out of main body 12 when valve 16 is in the closed position. This allows main body 12 to be inflated over a period of time without allowing previously introduced air to escape. Once main body 12 is fully inflated, cap 16*b* is placed onto valve cylinder 16*a*. For further security, the entire valve 16 can then be pushed into the surface of main body 12. It is noted that other types of one way or traditional inflation valves can be used with device 10 and secured to main body 12**.

The recreational floatation device 10 also includes at least two inflatable bladders 18, which are encompassed by main body 12. Bladders 18 are also positioned alone the horizontal axis and are adjacent to openings 14. As shown more clearly in FIGS. 2 and 3, inflatable bladders 18 provide emergency buoyancy and balance to the floatation device 10 should main body 12 lose air. Bladders 18 can be individually formed in any shape and size, provided they can be encompassed in main body 12. Bladders 18 are typically made of the same material as main body 12 due to the relative inexpensive processing costs. It is noted, however, that other cheaper materials can be used to form bladders 18 because bladders 18 are not exposed to the atmosphere. Similarly, a lesser gauge material can be used in constructing bladders 18. As noted, bladders 18 are positioned along the horizontal axis, adjacent to openings 14 to provide emergency buoyancy and balance to device 10 while further supporting users 11 situated in openings 14.

Each of the bladders 18 include a bladder valve 20 which is also secured on main body 12. Valves 20, similarly to valves 16, can be any standard inflation valve, which are commercially available and known to those of skill in the art. Preferably, valves 20 are self sealing, or one way valves commonly known as safety valves, which allow air flow into bladders 18. Air will not flow into or out of bladders 18 when valves 20 are in the closed position. Once bladder 18 is fully inflated, cap **20*b* is placed onto valve cylinder 20*a*. For further security, valves 20 can then be pushed into the surface of main body 12 (and bladder 18) surface. It is noted that if bladders 18 are deflated through valves 20, main body 12 will soften due to an overall air pressure loss within the floatation device. Other types of one-way, or traditional inflation valves, can be used with device 10 and secured to main body 12. It is preferable however, to use the same valves for the main body and the bladders as the cost of the valves is nominal. In operation, bladders 18 are inflated prior to main body 12 because the inflated internal air pressure of main body 12 would make it difficult for the bladders 18** to be inflated.

Figure 4:
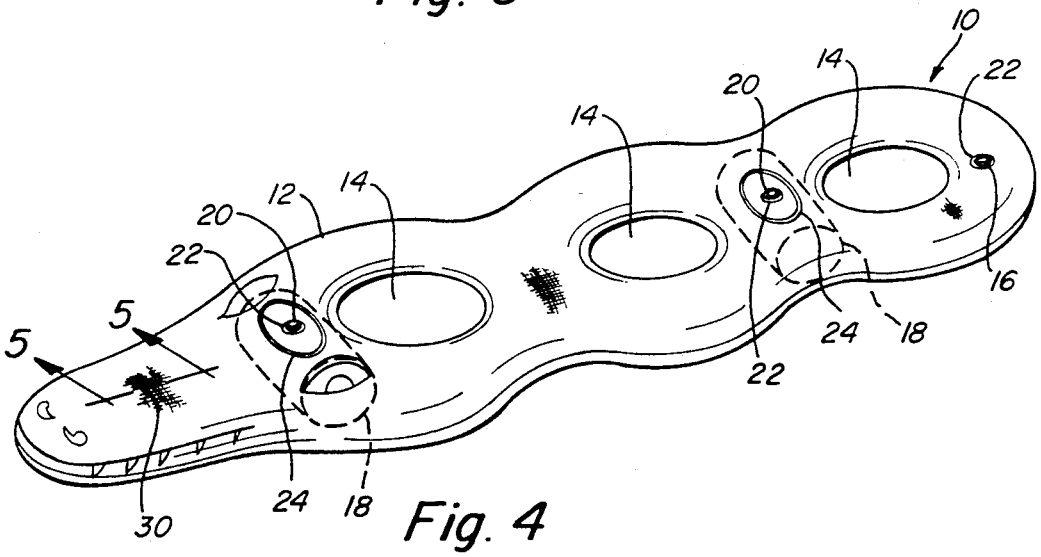
FIG. 4 is a top perspective view of an alternative embodiment of the present invention.

All of the valves 16, 20 which are used with device 10 are secured to main body 12. The valves can be secured to main body 12, for example, with an adhesive, a heat seal, and other methods known to those skilled in the art. Similarly, bladders 18 may be secured to main body 12 by any method known to those skilled in the art. FIG. 4 shows valve heat seals 22, as well as bladder heat seals 24.

It is noted that floatation device 10 of the present invention can be shaped and designed in a wide variety of aesthetically pleasing figures, such as a fish, a boat, or an animal. FIG. 1, for example, shows device 10 shaped and designed as a fish; while FIG. 4 shows device 10 shaped and designed as an alligator. It is understood that many other designs and shapes can be used with the recreational floatation device of the present invention.

Figure 5:
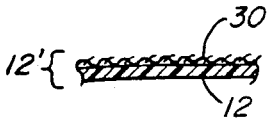
FIG. 5 is a cross sectional view of the inflatable main body and fabric material covering of the recreational floatation device of the present invention, taken along line 5—5 of FIG. 4.

In an alternative embodiment of the present invention, main body 12 of the floatation device 10 can be covered by a stretchable fabric material 30, as shown in FIGS. 4 and 5. Material 30 can be selected from a wide variety of fabrics to provide floatation device 10 with added user comfort and enhanced aesthetic effects. Material 30 is typically selected from synthetic fabrics due to their resistance to mildew, insects, weathering, chemicals, and the like. In addition, these fabrics can be dyed and designed as desired. Furthermore, a fabric covering of device 10 can be readily applied and/or replaced. Typically, the synthetic fiber material covering is selected from the group consisting of acrylic, modacrylic, polyester, nylon, and the like. Preferably, a stretchable nylon yarn is used due to its advantageous physical properties, its relative availability and inexpensive cost. Typically, the stretchable nylon yarn is between about 50 denier to about 100 denier; preferably a 70 denier knitted stretchable nylon fabric is used, which provides a comfortable, stretchable, and strong fabric covering on device 10. The expansion of fabric material 30 and main body 12 is generated by users blowing into device 10 through valves 16 and 20, as noted above. The fabric material 30 can be aesthetically pleasing as by the use of bright or contrasting colors and color arrangements, designs and the like. The feel or touch of the inflatable devices are enhanced by the fabric feel to the body of a user. FIG. 5 shows a cross sectional view of main body 12 with material covering 30 forming floatation device shell 12'.

In still other alternate embodiments of the invention (not shown) a single plastic-walled, inflatable, ring shaped recreational floatation device can be made aesthetically pleasing and comfortable to the touch of a user by providing the stretchable fabric material covering, as noted above.

The present invention will be further illustrated by the following example, which is intended to be illustrative in nature and is not to be construed as limiting the scope of the invention.

EXAMPLE

One suitable construction of a recreational floatation device having a shape and design substantially in accordance with the present invention is provided by the following combination of elements.

A recreational floatation device is provided, as shown in FIG. 4. The device includes an inflatable main body constructed of 10 gauge thickness polyvinyl chloride. The main body is approximately 74 inches long and 20 inches wide at the three widest portions, and 16 inches wide between the widest portions. The floatation device includes three openings positioned along the horizontal axis. The circular openings have diameters of approximately 7.25 inches and are spaced approximately 10.5 inches apart. The main body valve is heat sealed to an upper rear portion of the device.

Two inflatable bladders, also made of 10 gauge thickness polyvinyl chloride, are positioned along the horizontal axis and are adjacent to the openings in the main body. The first bladder is positioned in front of the first opening, while the second bladder is positioned between the second and third opening. The bladders are rectangular shaped, approximately 11 inches long and 8 inches wide, when they are in a flattened configuration. Each bladder has a bladder valve which is heat sealed to an upper portion of the main body. Each bladder is also heat sealed to an upper portion of the main body.

A 70 denier, knitted 100% nylon stretchable fabric is used to cover the main body. The fabric is designed as an alligator. Two sections of the nylon fabric are cut in the shape of the main body and are sewn together to cover the polyvinyl chloride body. Holes are provided in the fabric covering which allow the above noted valves to protrude to the surface of the covered main body. Grommets are attached to the holes to reinforce the holes. To inflate the floatation device, the bladders are inflated with air blown through the bladder valves. After the bladders are inflated, the main body is inflated with air blown through the main body valve. After the bladders and main body are inflated, the floatation device has as buoyancy in water sufficient to support three users, preferably children. The fabric material expands as the underlying main body expands from its original configuration.

Although particular embodiments of the invention have been described in detail for purposes of illustration, various modifications may be made without departing from the spirit and scope of the invention. For example, the fabric covered plastic or polymeric material walls of the main body of a floatation device can be of various sizes and configurations. Such devices can be simple floatation rings, collars, pillows or the like. The fabric can be loosely applied to the plastic wall forming the body or bladder, or can be snugly applied and stretched as the body or bladder is inflated for use to a final dimension. In some cases to fabric can be adhered to the plastic wall by yieldable cement, such as a latex cement. Accordingly, the invention is not to be limited except as by the appended claims.

What is claimed is:

1. A recreational flotation device, comprising:

an inflatable main body having an elongated horizontal axis and a flattened configuration, said main body having at least two openings, each sized to receive a user, and positioned a predetermined distanced along said horizontal axis;

a main body valve secured on said main body; and at least two inflatable bladders are positioned along said horizontal axis adjacent to said openings, each of said bladders having a bladder valve secured on said main body, wherein said main body and said bladders are inflatable through said main body and bladder valves, respectively, and said main body has an encompassing relationship with respect to said bladders, said main body, when gas inflated, having a buoyancy in water sufficient to support a plurality of users.

2. The floatation device of claim 1 wherein said main body is constructed of a soft, flexible, resilient material.

3. The floatation device of claim 2 wherein said material is polyvinyl chloride.

4. The floatation device of claim 1 wherein said main body is constructed of a material having a thickness of between about 5 and about 15 gauge.

5. The floatation device of claim 4 wherein said material has a thickness of about 10 gauge.

6. The floatation device of claim 1 wherein said openings are sized and shaped to receive the torso of a user.

7. The floatation device of claim 6 wherein said openings are positioned to allow the arms of a user to engage a body of water for maneuvering said device from one location to another in said body of water.

8. The floatation device of claim 1 wherein said main body valve is a self sealing valve.

9. The floatation device of claim 1 wherein said main body and bladder valves are self-sealing valves.

10. The floatation device of claim 1 wherein said main body is in the shape of a fish.

11. The floatation device of claim 1 wherein said main body is in the shape of an animal.

12. The floatation device of claim 1 wherein said main body is covered by a stretchable fabric material.

13. The floatation device of claim 12 wherein said material is made of synthetic fibers.

14. The floatation device of claim 13 wherein said material is made of nylon.

* * * * *